US009031451B2

(12) United States Patent
Rulon et al.

(10) Patent No.: US 9,031,451 B2
(45) Date of Patent: May 12, 2015

(54) TONER CARTRIDGE HAVING A SHUTTER LOCK MECHANISM

(71) Applicant: Lexmark International, Inc., Lexington, KY (US)

(72) Inventors: Darrell Stephen Rulon, Lexington, KY (US); John Andrew Buchanan, Paris, KY (US); James Anthany Carter, II, Lexington, KY (US); Gregory Alan Cavill, Winchester, KY (US); Mark Duane Foster, Lexington, KY (US); Benjamin Keith Newman, Lexington, KY (US); Matthew Lee Rogers, Lexington, KY (US); Keith Seaman, Lexington, KY (US); Christopher Gene Vowels, Boston, KY (US); Tyler Frederick Williams, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 105 days.

(21) Appl. No.: 13/780,042

(22) Filed: Feb. 28, 2013

(65) Prior Publication Data

US 2014/0241758 A1 Aug. 28, 2014

(51) Int. Cl.

| | |
|---|---|
| ***G03G 15/08*** | (2006.01) |
| ***G03G 21/18*** | (2006.01) |
| ***G03G 21/00*** | (2006.01) |

(52) U.S. Cl.

CPC ..... *G03G 15/08* (2013.01); *G03G 21/00* (2013.01); *G03G 21/1842* (2013.01); *G03G 2215/0692* (2013.01)

(58) Field of Classification Search

CPC ..... G03G 21/1842

USPC ..... 399/106, 260

See application file for complete search history.

(56) References Cited

U.S. PATENT DOCUMENTS 5,083,158 A 1/1992 Kashima et al.
5,121,165 A 6/1992 Yoshida et al.

(Continued)

FOREIGN PATENT DOCUMENTS

JP 2000-356895 A 12/2000

OTHER PUBLICATIONS

Prosecution history of copending U.S. Appl. No. 13/340,876 including Non-Final Office Action dated Nov. 27, 2013.

(Continued)

*Primary Examiner* — Clayton E Laballe
*Assistant Examiner* — Leon W Rhodes, Jr.
(74) *Attorney, Agent, or Firm* — Justin M Tromp

(57) ABSTRACT

An example toner cartridge includes a reservoir for containing toner and an exit port in fluid communication with the reservoir. A shutter is positioned at the exit port and movable between an open position and a closed position. A first linkage member is operatively connected to the shutter to open the shutter upon being actuated by a first engagement feature. A second linkage member is pivotally attached to a side wall of the housing and biased toward a home position. A third linkage member is movable with the second linkage member. When the second linkage member is in the home position, the third linkage member is in a blocking position preventing the first linkage member from opening the shutter. When the second linkage member pivots away from the home position, the third linkage member moves to a non-blocking position permitting the first linkage member to open the shutter.

15 Claims, 13 Drawing Sheets

(56) References Cited

U.S. PATENT DOCUMENTS

| | | | | |
|---|---|---|---|---|
| 5,608,501 | A | 3/1997 | Makino | |
| 5,758,233 | A | 5/1998 | Coffey et al. | |
| 5,848,342 | A | 12/1998 | Tanda | |
| 6,014,536 | A | 1/2000 | Ban et al. | |
| 6,128,453 | A | 10/2000 | Ban et al. | |
| 6,144,821 | A | 11/2000 | Oguma | |
| 6,259,874 | B1 | 7/2001 | Murakami et al. | |
| 6,266,505 | B1 | 7/2001 | Ban et al. | |
| 6,594,458 | B2 | 7/2003 | Ban et al. | |
| 6,792,228 | B2 | 9/2004 | Ban et al. | |
| 6,853,828 | B2 | 2/2005 | Ban et al. | |
| 6,968,139 | B2 | 11/2005 | Ban et al. | |
| 6,978,101 | B2 | 12/2005 | Ban et al. | |
| 7,149,457 | B2 * | 12/2006 | Miyabe et al. | 399/114 |
| 7,386,250 | B2 | 6/2008 | Ban et al. | |
| 7,548,710 | B2 | 6/2009 | Gayne et al. | |
| 7,606,520 | B2 | 10/2009 | Dawson | |
| 7,738,817 | B2 * | 6/2010 | Sasae et al. | 399/258 |
| 7,848,684 | B2 * | 12/2010 | Kawai | 399/258 |
| 8,165,505 | B2 | 4/2012 | Kojima | |
| 8,682,213 | B2 * | 3/2014 | Carter et al. | 399/111 |
| 8,693,926 | B2 * | 4/2014 | Nagashima et al. | 399/262 |
| 2001/0001025 | A1 | 5/2001 | Nakajima | |
| 2003/0223775 | A1 | 12/2003 | Yoshino et al. | |
| 2005/0169672 | A1 | 8/2005 | Ban et al. | |
| 2005/0201777 | A1 | 9/2005 | Konishi | |
| 2006/0067725 | A1 | 3/2006 | Miyabe et al. | |
| 2006/0171744 | A1 | 8/2006 | Ikeda et al. | |
| 2007/0003325 | A1 | 1/2007 | Jung et al. | |
| 2007/0212118 | A1 | 9/2007 | Nagae et al. | |
| 2007/0286634 | A1 | 12/2007 | Blaine et al. | |
| 2008/0101821 | A1 | 5/2008 | Gayne et al. | |
| 2009/0142103 | A1 | 6/2009 | Chaudhuri et al. | |
| 2010/0221039 | A1 | 9/2010 | Kawai et al. | |

OTHER PUBLICATIONS

Prosecution history of copending U.S. Appl. No. 13/340,884 including Notice of Allowance dated Oct. 22, 2013.
Prosecution history of copending U.S. Appl. No. 13/340,797 including Notice of Allowance dated Oct. 9, 2013.
International Search Report and Written Opinion of the International Searching Authority dated Jan. 31, 2013 for PCT Application No. PCT/US12/65152 (6 pages).
International Search Report and Written Opinion of the International Searching Authority dated Jan. 31, 2013 for PCT Application No. PCT/US12/65149 (7 pages).
International Search Report and Written Opinion of the International Searching Authority dated Jan. 28, 2013 for PCT Application No. PCT/US12/65147 (12 pages).
Co-pending U.S. Appl Nos. 13/340,876, 13/340,881, 13/340,884, 13/340,935 and 13/340,797 all filed Dec. 30, 2011 and U.S. Appl. No. 13/723,888, filed Dec. 21, 2012.
Prosecution history of U.S. Appl. No. 13/340,935 including Non-Final Office Action dated May 22, 2014.
Prosecution history of copending U.S. Appl. No. 13/420,956 including Non-Final Office Action dated Sep. 9, 2013.
Copending U.S. Appl. No. 13/919,015, filed Jun. 17, 2013.
Copending U.S. Appl. No. 13/919,021, filed Jun. 17, 2013.
Prosecution history for copending U.S. Appl. No. 13/340,797 including Non-Final Office Action dated Jun. 7, 2013.
Prosecution history for copending U.S. Appl. No. 13/723,888 including Non-Final Office Action dated Jun. 6, 2013.
Prosecution history for copending U.S. Appl. No. 13/340,881 including Notice of Allowance dated Aug. 6, 2013.
International Search Report and Written Opinion of the International Searching Authority dated May 28, 2014 for PCT Application No. PCT/US2014/016775.
Prosecution history of U.S. Appl. No. 13/340,935 including Notice of Allowance dated Aug. 22, 2014.

* cited by examiner

TONER CARTRIDGE HAVING A SHUTTER LOCK MECHANISM

CROSS REFERENCES TO RELATED APPLICATIONS

This patent application is related to U.S. patent application Ser. No. 13/340,876, filed Dec. 30, 2011, entitled "Toner Cartridge having a Shutter Lock Mechanism", U.S. patent application Ser. No. 13/340,881, filed Dec. 30, 2011, entitled "Toner Cartridge having a Shutter Lock Mechanism", U.S. patent application Ser. No. 13/340,884, filed Dec. 30, 2011, entitled "Toner Cartridge having a Shutter Lock Mechanism", U.S. patent application Ser. No. 13/340,935, filed Dec. 30, 2011, entitled "Toner Cartridge for Use in an Image Forming Device", and U.S. patent application Ser. No. 13/340,797, filed Dec. 30, 2011, entitled "Toner Cartridge having a Pivoting Exit Port Cover", all of which are assigned to the assignee of the present application.

BACKGROUND

1. Field of the Disclosure

The present disclosure relates generally to toner cartridges used in electrophotographic image forming devices and, more particularly, to a toner cartridge having a shutter lock mechanism.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

To deliver toner from the toner cartridge to the imaging unit, an auger in the toner cartridge may be used to feed toner from an exit port on the toner cartridge into an entrance port on the imaging unit and into a second auger that disperses the toner within the imaging unit. As the toner is drawn out of the toner cartridge, it is augured through a shutter used for sealing the exit port of the toner cartridge when it is not inserted in the printer. In order to prevent the undesired release of toner, the shutter preferably remains closed unless the toner cartridge is installed in the image forming device. Accordingly, the shutter may be biased toward the closed position. As the toner cartridge reaches its final position in the image forming device, a pin or other type of projection on the image forming device may engage a catch on the toner cartridge and supply an opposing force to open the shutter. For example, U.S. Pat. No. 7,606,520, entitled "Shutter for a Toner Cartridge for Use with an Image Forming Device" and assigned to the assignee of the present invention provides an example shutter mechanism.

A problem may be experienced if a user accidentally releases toner from the cartridge by inadvertently actuating the shutter or by intentionally engaging the shutter catch without appreciating its purpose until it is too late. The released toner may fall from the toner cartridge and contact an area surrounding the image forming device or a user's clothing resulting in uncleanliness. Image forming devices having a separate toner cartridge and imaging unit present an additional concern. If the imaging unit is not present when the toner cartridge is installed in the image forming device and the cartridge's shutter is opened by the image forming device, any toner exiting the shutter will leak from the cartridge's exit port into the interior of the image forming device because the imaging unit is not there to receive it. When leaked toner falls into the internal portions of the image forming device, it can cause reliability issues and, in some cases, print defects. Accordingly, it will be appreciated that a mechanism that prevents the unwanted release of toner from the cartridge's shutter is desired.

SUMMARY

A toner cartridge for use in an image forming device according to one example embodiment includes a housing having a reservoir for containing toner therein. The housing has an exit port on a front portion of the housing in fluid communication with the reservoir. A shutter is positioned at the exit port that is movable between an open position to permit toner from the reservoir to pass out of the exit port and a closed position to prevent toner from passing out of the exit port. The shutter is biased toward the closed position. A first linkage member is operatively connected to the shutter to open the shutter upon being actuated by a first engagement feature in the image forming device. The first linkage member has a first engagement surface positioned on a rear portion of the housing to contact the first engagement feature to open the shutter. A second linkage member is pivotally attached to a side wall of the housing and biased toward a home position. The second linkage member has a second engagement surface positioned on the front portion of the housing to contact a second engagement feature to pivot the second linkage member away from the home position. A third linkage member is movable with the second linkage member. When the second linkage member is in the home position, the third linkage member is in a blocking position preventing the first linkage member from opening the shutter. When the second linkage member pivots away from the home position, the third linkage member moves to a non-blocking position permitting the first linkage member to open the shutter upon being actuated by the first engagement feature.

A toner cartridge for use in an image forming device according to another example embodiment includes a housing having a reservoir for containing toner therein. The housing has an exit port on a front portion of the housing in fluid communication with the reservoir. A shutter is positioned at the exit port that is movable between an open position to permit toner from the reservoir to pass out of the exit port and a closed position to prevent toner from passing out of the exit port. The shutter is biased toward the closed position. A cover is mounted on an exterior portion of the housing and pivotable between a closed position covering the exit port and an open position uncovering the exit port. The cover is biased toward the closed position. A first linkage member is operatively connected to the shutter to open the shutter upon being actuated by a first engagement feature in the image forming device. The first linkage member has a first engagement surface positioned on a rear portion of the housing to contact the first engagement feature to open the shutter. A second linkage member is pivotally attached to a side wall of the housing and biased toward a home position. The second linkage member has a second engagement surface positioned on the front portion of the housing to contact a second engagement feature to pivot the second linkage member away from the home position. A third linkage member is movable with the second linkage member and operatively connected to the cover such that when the second linkage member is in the home position, the cover is in the closed position. When the second linkage member pivots away from the home position, the third linkage member moves the cover to the open position. When the second linkage member is in the home position, the third linkage member is in a blocking position preventing the first linkage member from opening the shutter. When the second linkage member pivots away from the home position, the third linkage member moves to a non-blocking position permitting the first linkage member to open the shutter upon being actuated by the first engagement feature.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
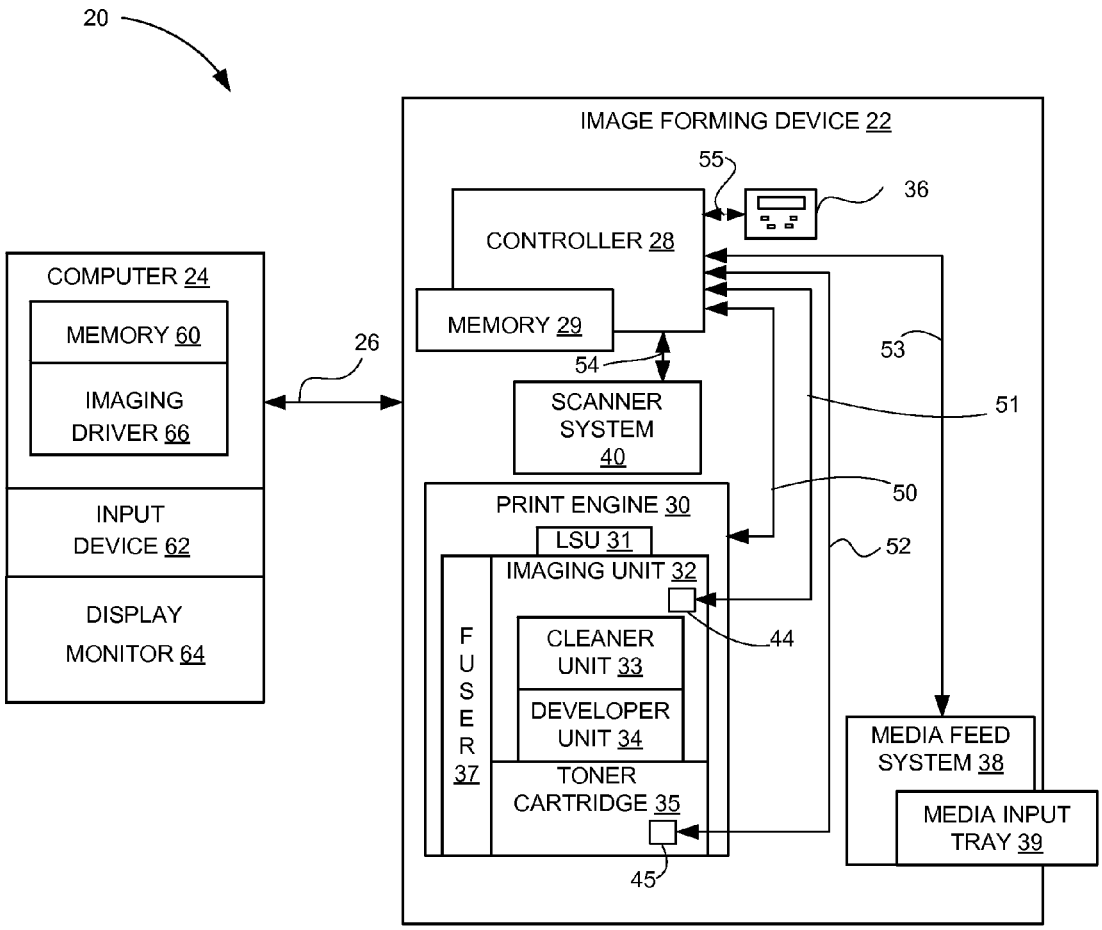
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32 and fuser 37, all mounted within image forming device 22. Imaging unit 32 is removably mounted in image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
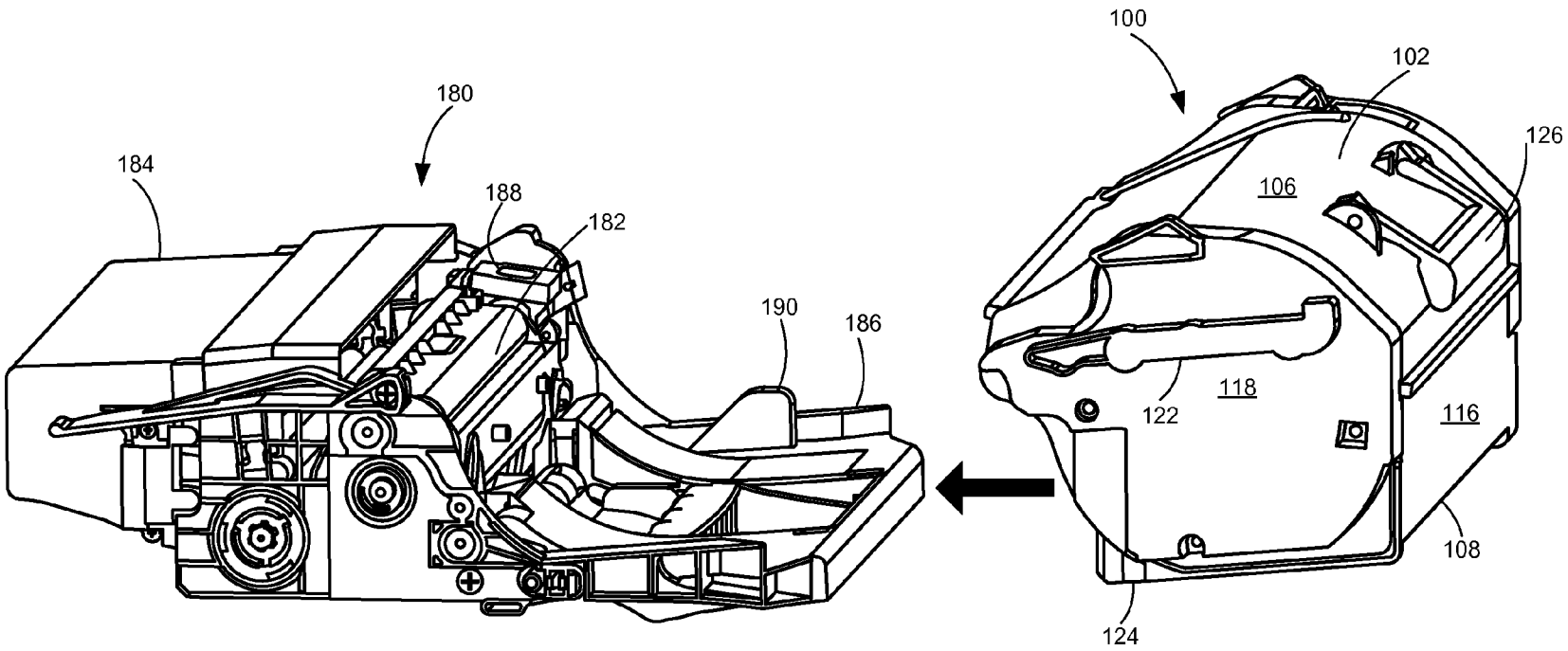
FIG. 2 is a perspective view of a toner cartridge and an imaging unit according to one example embodiment.
Figure 3:
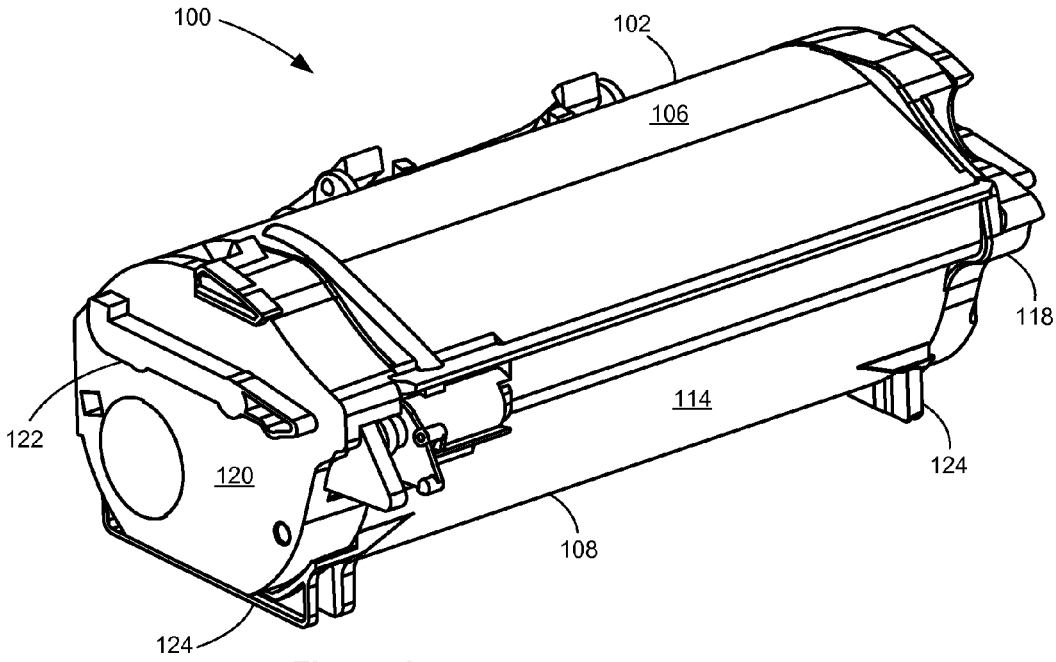
FIGS. 3 and 4 are additional perspective views of the toner cartridge shown in FIG. 2.
Figure 4:
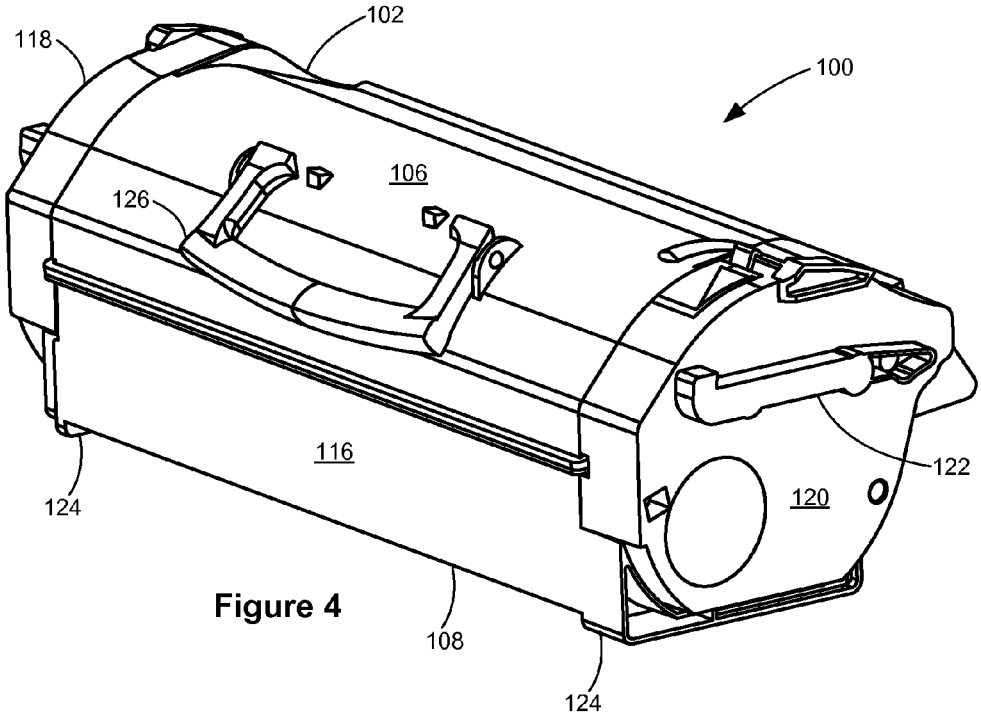

Referring now to FIG. 2, a toner cartridge 100 and an imaging unit 180 are shown according to one example embodiment. Imaging unit 180 includes a developer unit 182 and a cleaner unit 184 mounted on a common frame 186. As discussed above, imaging unit 180 and toner cartridge 100 are each removably installed in image forming device 22. Imaging unit 180 is first slidably inserted into image forming device 22. Toner cartridge 100 is then inserted into image forming device 22 and onto frame 186 in a mating relationship with developer unit 182 of imaging unit 180 as indicated by the arrow shown in FIG. 2. This arrangement allows toner cartridge 100 to be removed and reinserted easily when replacing an empty toner cartridge without having to remove imaging unit 180. Imaging unit 180 may also be readily removed as desired in order to maintain, repair or replace the components associated with developer unit 182, cleaning unit 184 or frame 186 or to clear a media jam.

With reference to FIGS. 2-5, toner cartridge 100 includes a housing 102 having an enclosed reservoir 104 (FIG. 5) for holding a quantity of toner therein. Housing 102 may be viewed as having a top or lid 106 mounted on a base 108. Base 108 includes first and second side walls 110, 112 connected to adjoining front and rear walls 114, 116. In one embodiment, top 106 is ultrasonically welded to base 108 thereby forming enclosed reservoir 104. First and second end caps 118, 120 are mounted to side walls 110, 112, respectively, and include guides 122 to assist the insertion of toner cartridge 100 into image forming device 22 for mating with developer unit 182. First and second end caps 118, 120 may be snap fitted into place or attached by screws or other fasteners. Guides 122 travel in corresponding channels within image forming device 22. Legs 124 may also be provided on a bottom portion of base 106 or end caps 118, 120 to assist with the insertion of toner cartridge 100 into image forming device 22. Legs 124 are received by frame 186 to facilitate the mating of toner cartridge 100 with developer unit 182. A handle 126 may be provided on top 106 or base 108 of toner cartridge 100 to assist with insertion and removal of toner cartridge 100 from imaging unit 180 and image forming device 22. As shown in FIG. 6, a fill port 128 is provided on side wall 112 that is used to fill toner cartridge 100 with toner. After filling, fill port 128 is closed by a plug 130 and/or cap 132.

Figure 5:
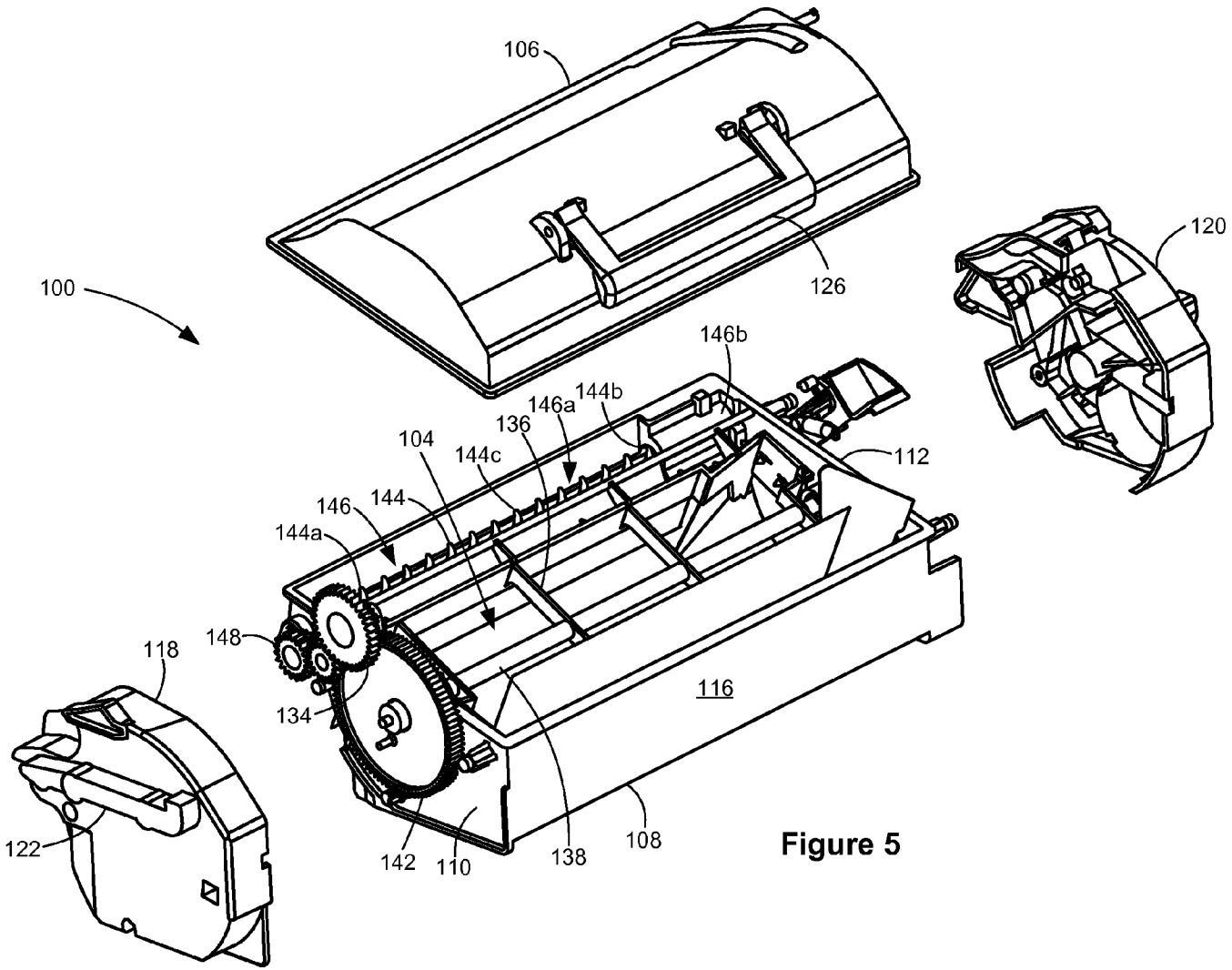
FIGS. 5 and 6 are exploded views of the toner cartridge shown in FIG. 2 showing a reservoir for holding toner therein.
Figure 6:
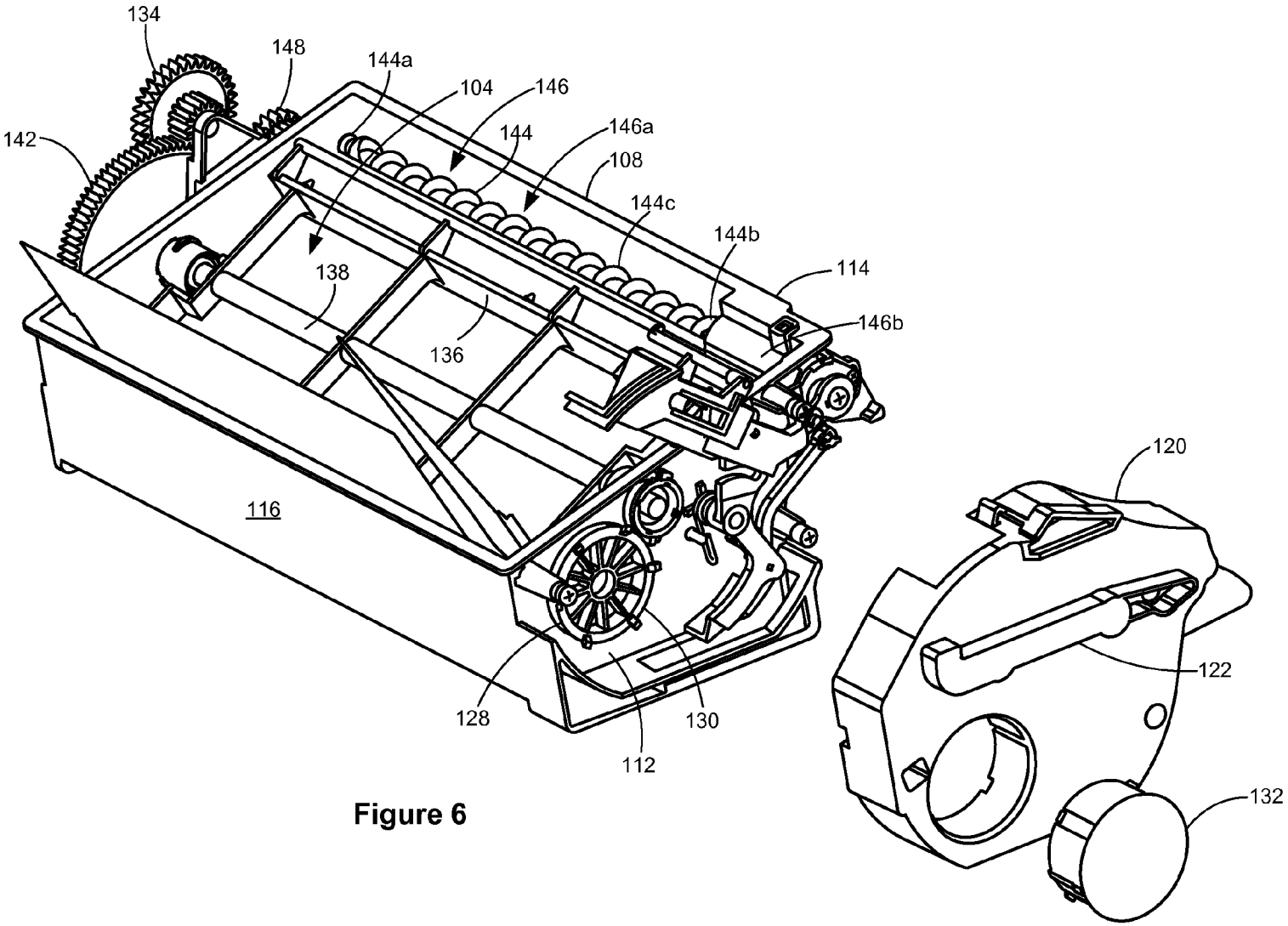

With reference to FIG. 5, various drive gears are housed within a space formed between end cap 118 and side wall 110. A main interface gear 134 engages with a drive system in image forming device 22 that provides torque to main interface gear 134. As discussed in greater detail below, various linkages are housed within a space formed between end cap 120 and side wall 112. One or more paddles 136 are rotatably mounted within toner reservoir 104 with first and second ends of a drive shaft 138 of paddle(s) 136 extending through aligned openings in side walls 110, 112, respectively. A drive gear 142 is provided on the first end of drive shaft 138 that engages with main interface gear 134 either directly or via one or more intermediate gears. Bushings may be provided on each end of drive shaft 138 where it passes through side walls 110, 112. Accordingly, side wall 110 may also be termed the "drive" or "driven" side of toner cartridge 100.

With reference to FIGS. 5 and 6, an auger 144 having first and second ends 144*a*, 144*b*, and a spiral screw flight 144*c* is positioned in a channel 146 extending along the width of front wall 114 between side walls 110, 112. Channel 146 may be integrally molded as part of front wall 114 or formed as a separate component that is attached to front wall 114. Channel 146 is generally horizontal in orientation along with toner cartridge 100 when toner cartridge 100 is installed in image forming device 22. First end 144*a* of auger 144 extends through side wall 110 and a drive gear 148 is provided on first end 144*a* that engages with main interface gear 134 either directly or via one or more intermediate gears. Channel 146 includes an open portion 146*a* and an enclosed portion 146*b*. Open portion 146*a* is open to toner reservoir 104 and extends from side wall 110 toward second end 144*b* of auger 144. Enclosed portion 146*b* of channel 146 extends from side wall 112 and encloses a shutter assembly 150 (FIG. 7) and second end 144*b* of auger 144. As paddle(s) 136 rotate, they deliver toner from toner reservoir 104 into open portion 146*a* of channel 146. Auger 144 is rotated via drive gear 148 to deliver toner received in channel 146 to shutter assembly 150. Shutter assembly 150 regulates whether toner is permitted to exit toner cartridge 100 through an exit port 152 provided in front wall 114 and shown in FIG. 7. In this embodiment, exit port 152 is disposed at the bottom of channel 146 so that gravity will assist in exiting toner through exit port 152.

Shutter assembly 150 is shown in more detail in FIGS. 8A, 8B, 9A and 9B. Shutter assembly 150 includes a shutter 154 that is rotatable between a closed position shown in FIGS. 8A and 9A and an open position shown in FIGS. 8B and 9B. Shutter 154 includes an open end 154*a* that receives second end 144*b* of auger 144 therein. As auger 144 rotates, it delivers toner from channel 146 to shutter 154. Shutter 154 includes a radial opening 154*b* that is connected to open end 154*a* by an internal channel in shutter 154. Radial opening 154*b* permits toner to exit toner cartridge 100 through exit port 152 as discussed in greater detail below.

Figure 7:
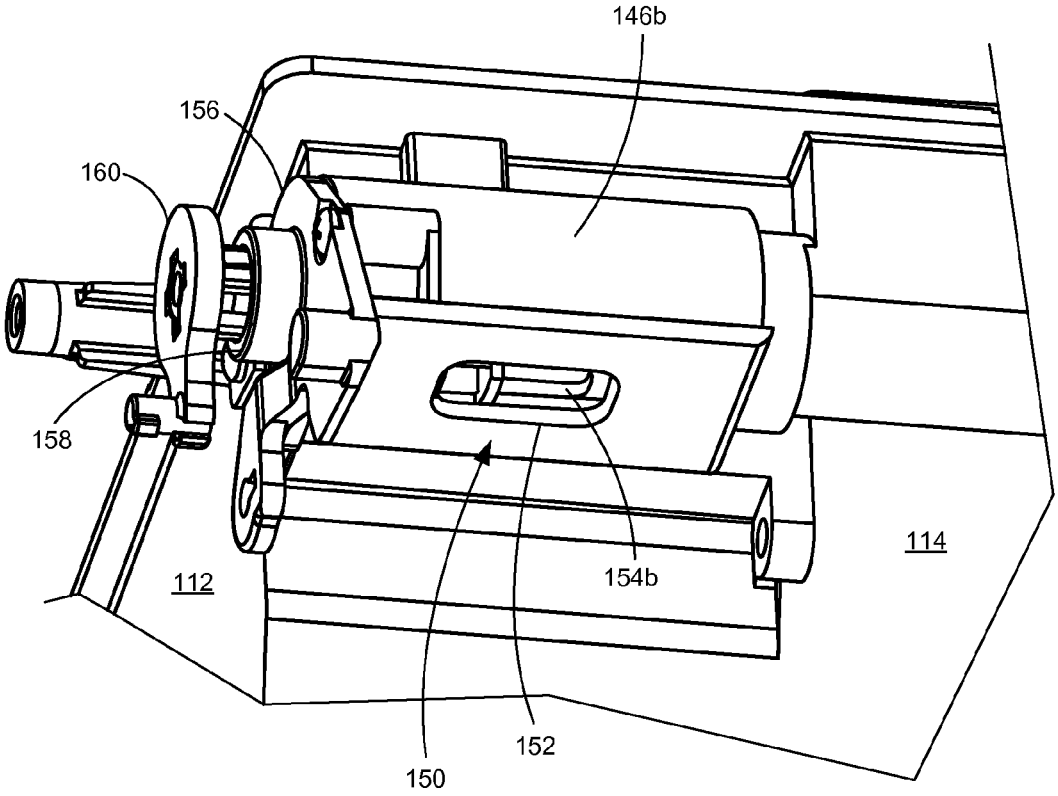
FIG. 7 is a perspective view of a front portion of the toner cartridge shown in FIG. 2 showing an exit port thereof.

A retaining member 156 is mounted on side wall 112 of toner cartridge 100 (FIG. 7). In the example embodiment illustrated, retaining member 156 is a separate component attached to housing 102; however, retaining member 156 may also be integrally molded as part of housing 102. Retaining member 156 includes a bushing 158 that receives a closed end 154*c* of shutter 154. Closed end 154*c* of shutter 154 is connected to a lever 160 that opens and closes shutter 154. In the example embodiment illustrated, closed end 154*c* of shutter 154 includes a key 162 and lever 160 includes a corresponding keyway 164. Key 162 and keyway 164 couple shutter 154 to lever 160 such that the rotation of lever 160 opens and closes shutter 154. It will be appreciated that this configuration may be reversed so that lever 160 includes a key and closed end 154*c* includes a corresponding keyway. In the embodiment illustrated, lever 160 is connected to closed end 154*c* via a fastener 166 that passes through keyway 164 and a threaded hole 168 in closed end 154*c*; however, lever 160 and shutter 154 may be connected by any suitable means such as by being snap fit together. A post 169 is provided on the distal end of lever 160.

Figure 8A:
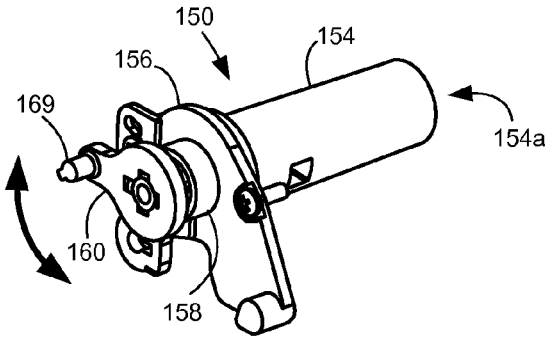
FIGS. 8A and 8B are perspective views of a shutter assembly for use with the toner cartridge in a closed position and an open position, respectively, according to one example embodiment.
Figure 8B:
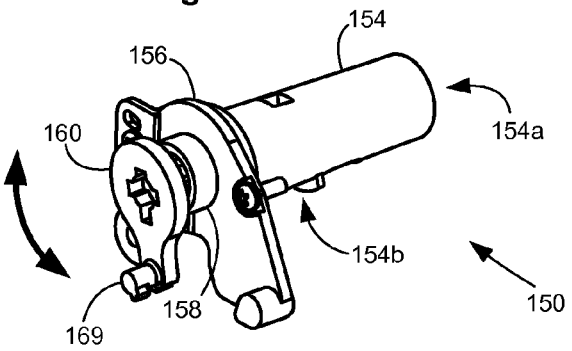
Figure 9A:
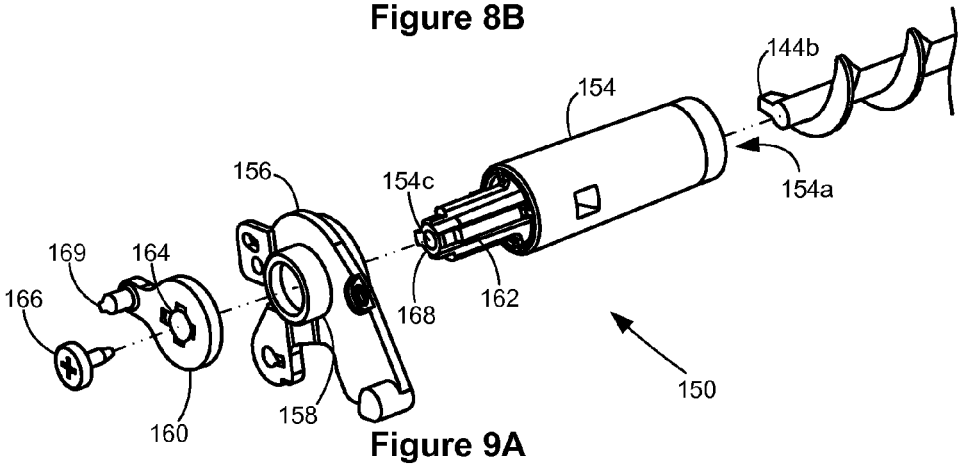
FIGS. 9A and 9B are exploded views of the shutter assembly shown in FIGS. 8A and 8B.
Figure 9B:
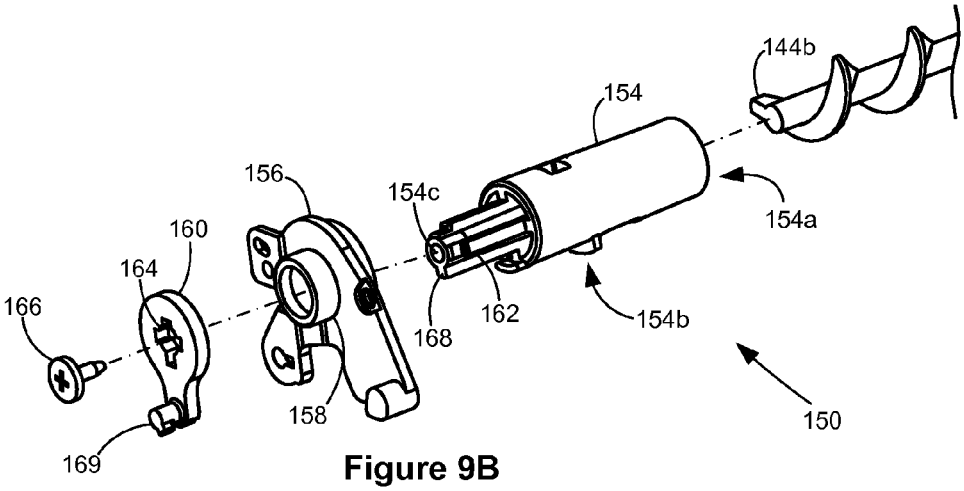

When lever 160 is in a first position shown in FIGS. 8A and 9A, shutter 154 is in a closed position with radial opening 154*b* positioned against an internal surface of enclosed portion 146*b* of channel 146 in order to prevent toner from exiting toner cartridge 100. When lever 160 rotates to a second position shown in FIGS. 8B and 9B, shutter 154 rotates to an open position where radial opening 154*b* is aligned with exit port 152 to permit toner to exit toner cartridge 100. When shutter 154 is in the open position, toner may be delivered from reservoir 104 of toner cartridge 100 to imaging unit 180 by rotating paddle(s) 136 and auger 144 as desired. Specifically, as paddle(s) 136 rotate, they deliver toner from toner reservoir 104 into open portion 146*a* of channel 146. As auger 144 rotates, it delivers toner received in channel 146 to shutter 154 through open end 154*a*. Toner passes through the internal channel in shutter 154 and out of radial opening 154*b* and exit port 152 into a corresponding entrance port 188 in developer unit 182 (FIG. 2).

Figure 10:
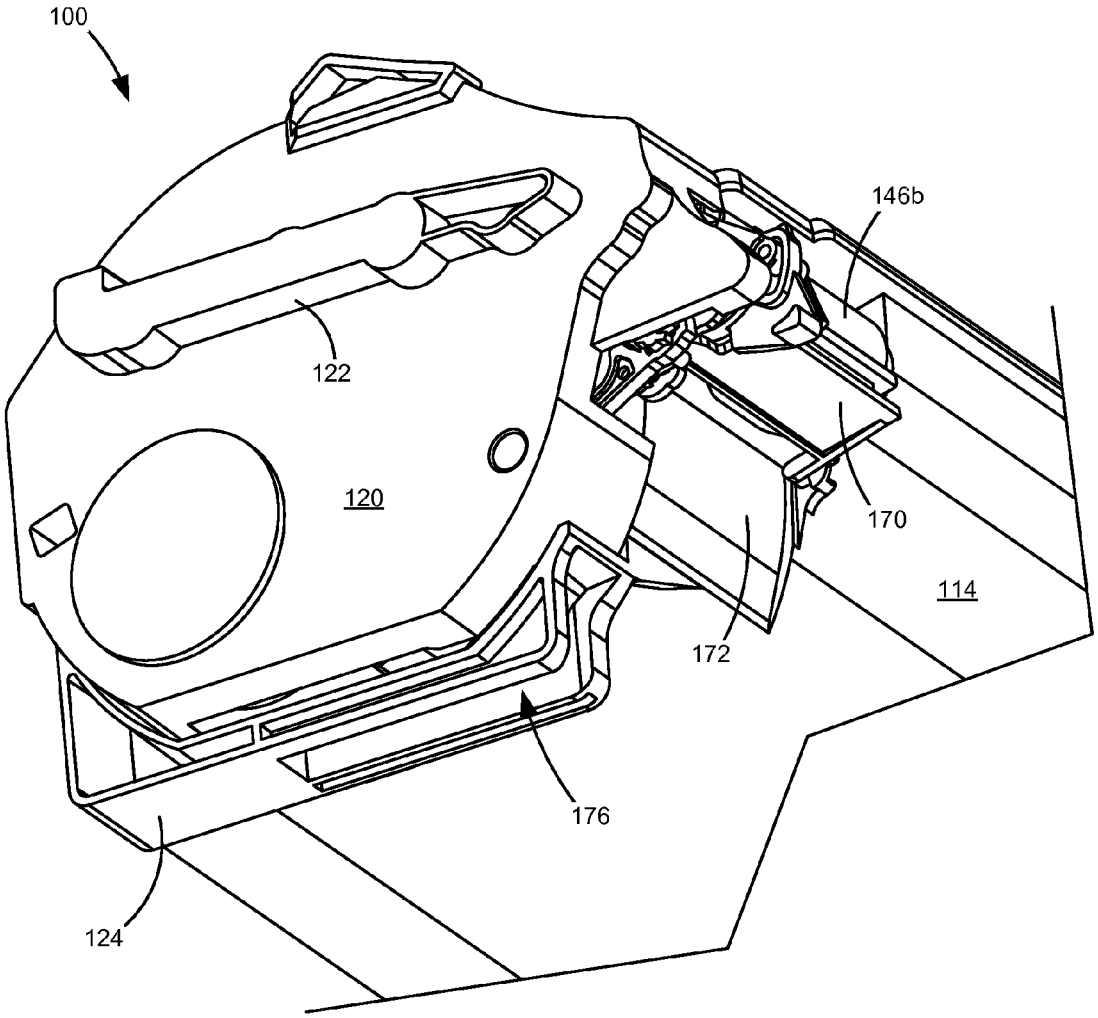
FIG. 10 is a perspective view of a toner cartridge having a pivoting exit port cover according to one example embodiment.
Figure 11:
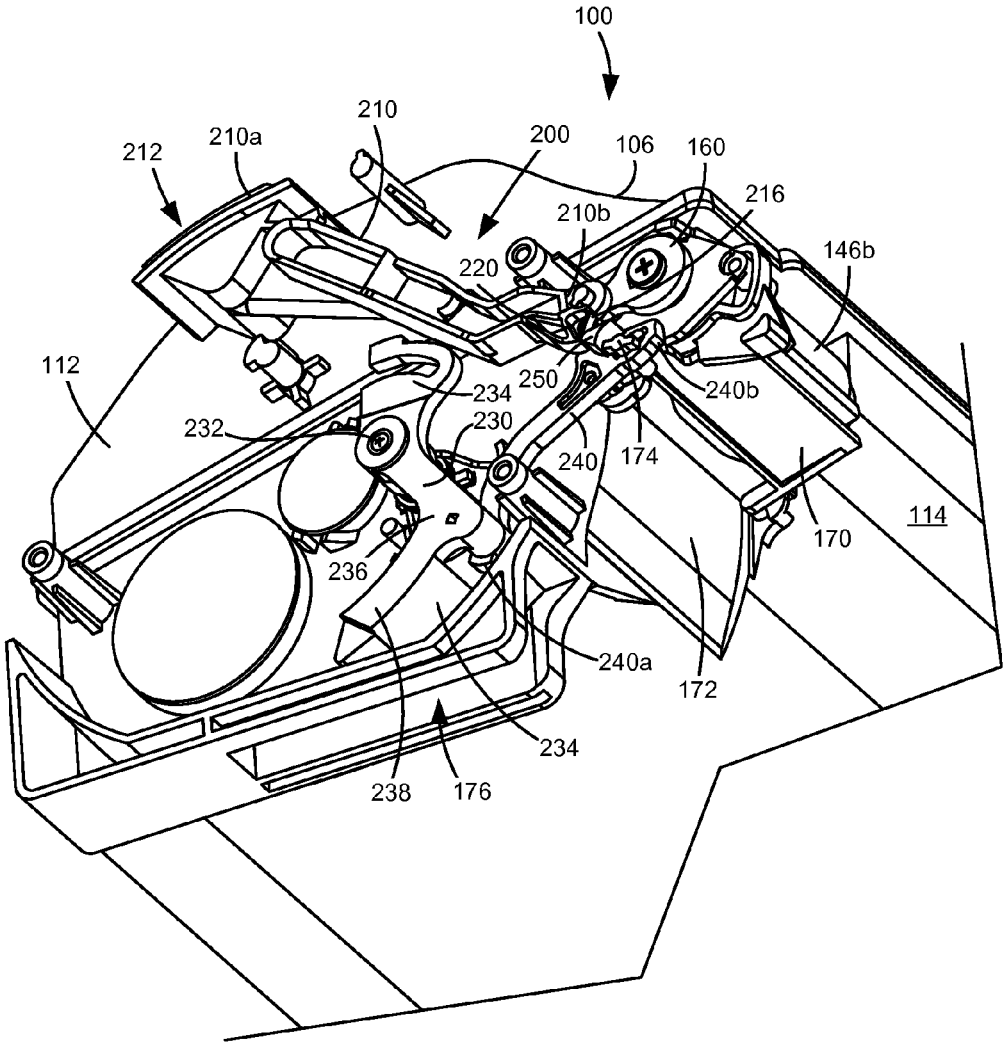
FIG. 11 is a perspective view of the toner cartridge shown in FIG. 10 with an end cap removed showing the cover in a closed position and a shutter lock mechanism in a locked position with a shutter closed.
Figure 12:
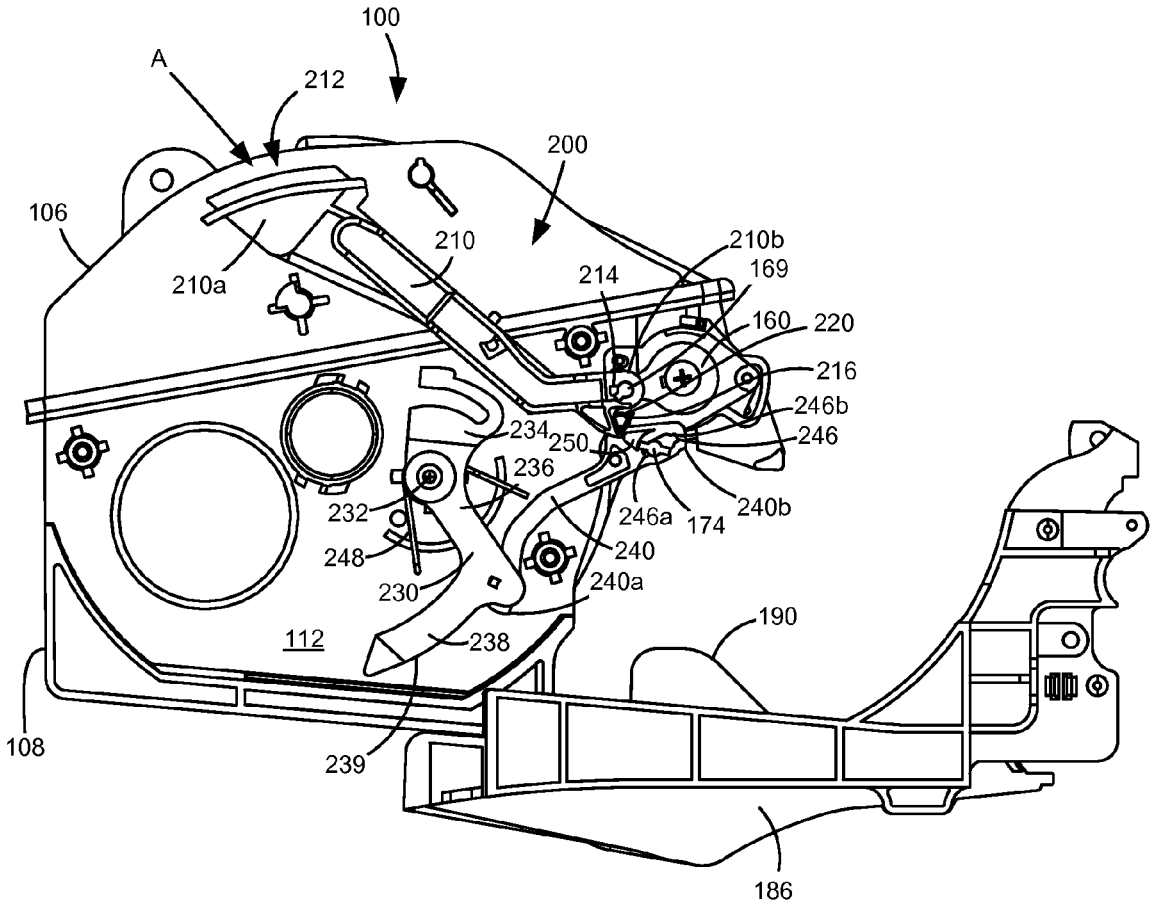
FIG. 12 is a side elevation view of the toner cartridge shown in FIGS. 10 and 11 with the end cap removed showing the shutter lock mechanism in the locked position with the shutter closed.
Figure 13:
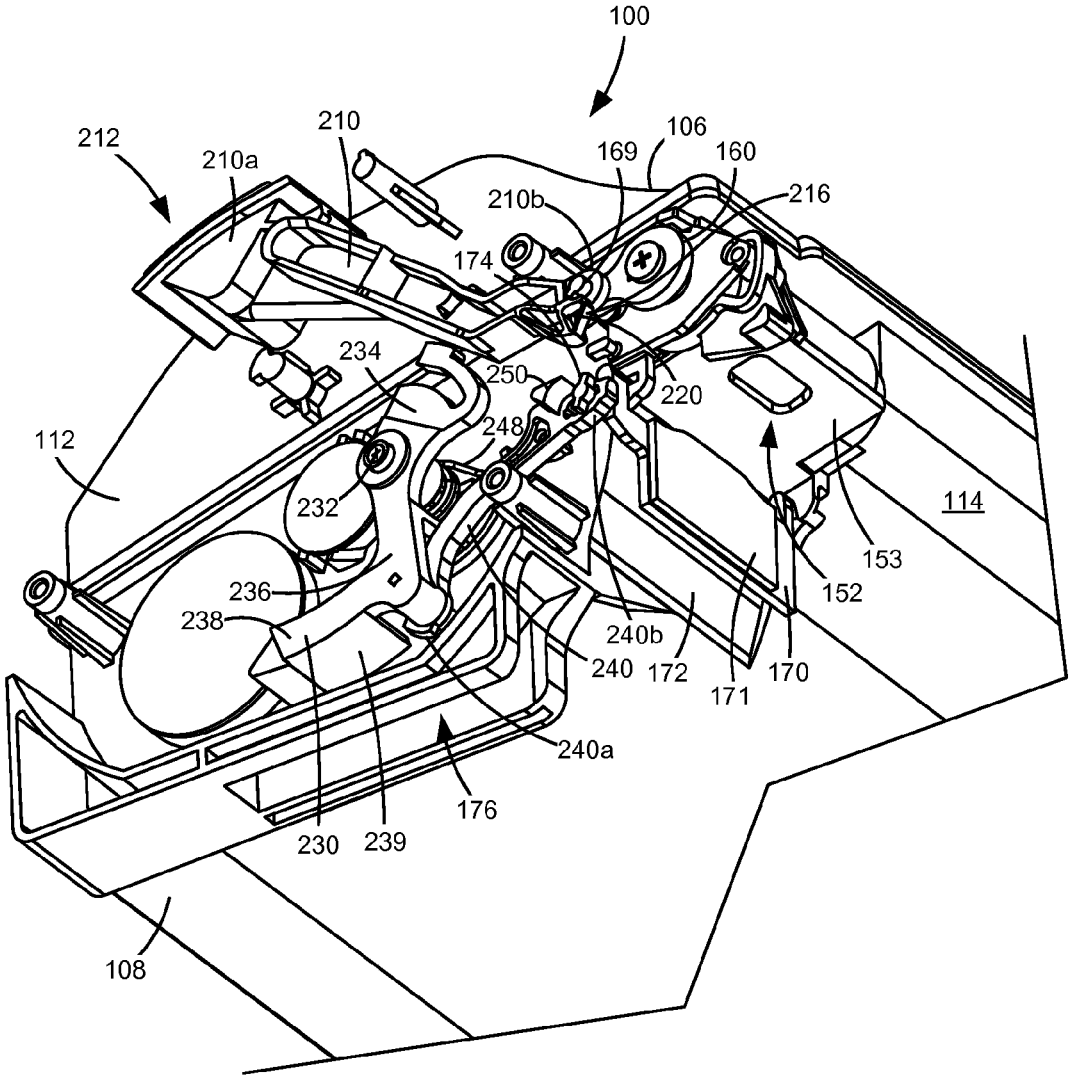
FIG. 13 is a perspective view of the toner cartridge shown in FIGS. 10-12 with the end cap removed showing the cover in an open position and the shutter lock mechanism in an unlocked position with the shutter closed.
Figure 14:
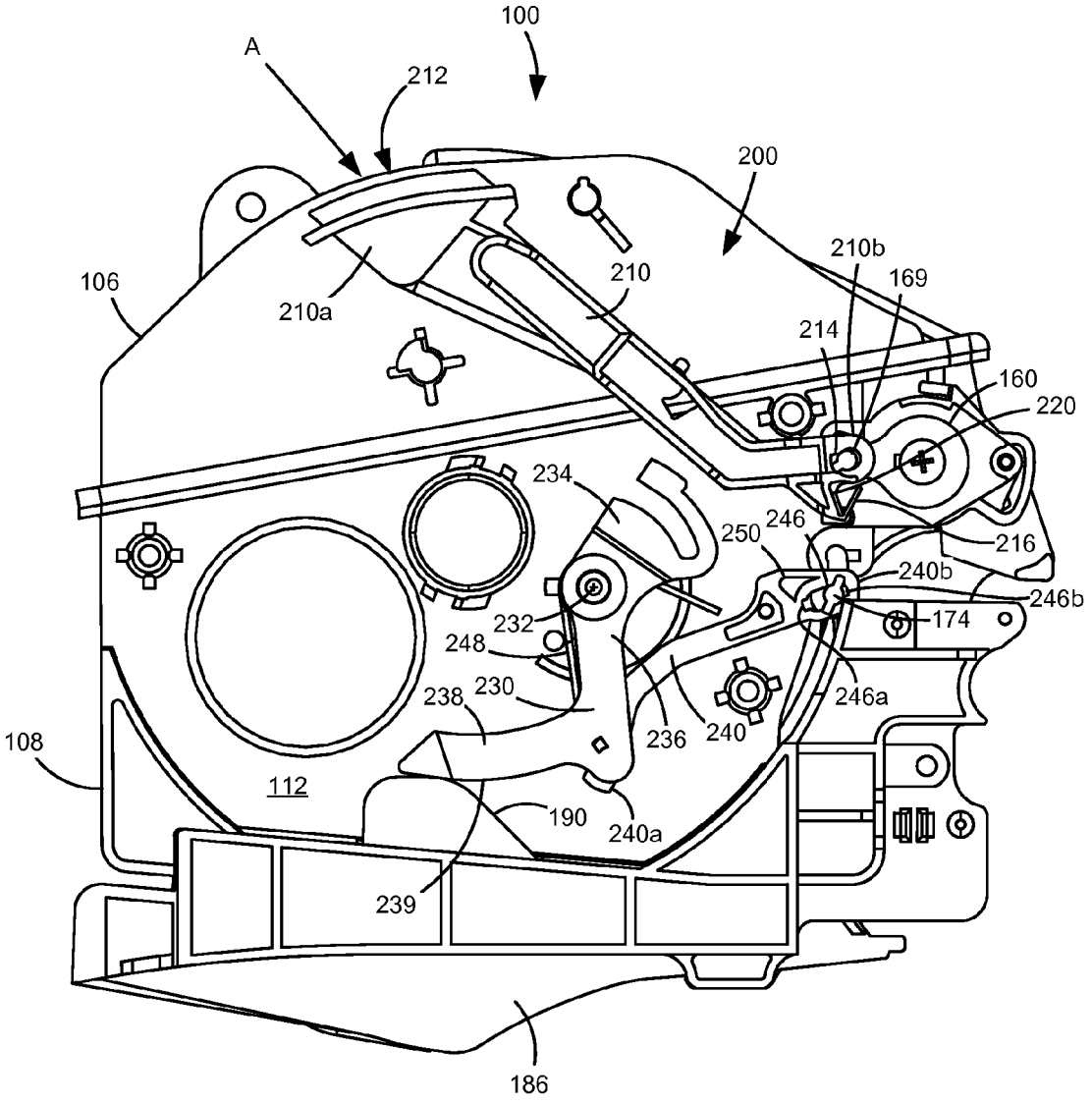
FIG. 14 is a side elevation view of the toner cartridge shown in FIGS. 10-13 showing the shutter lock mechanism in the unlocked position with the shutter closed.
Figure 15:
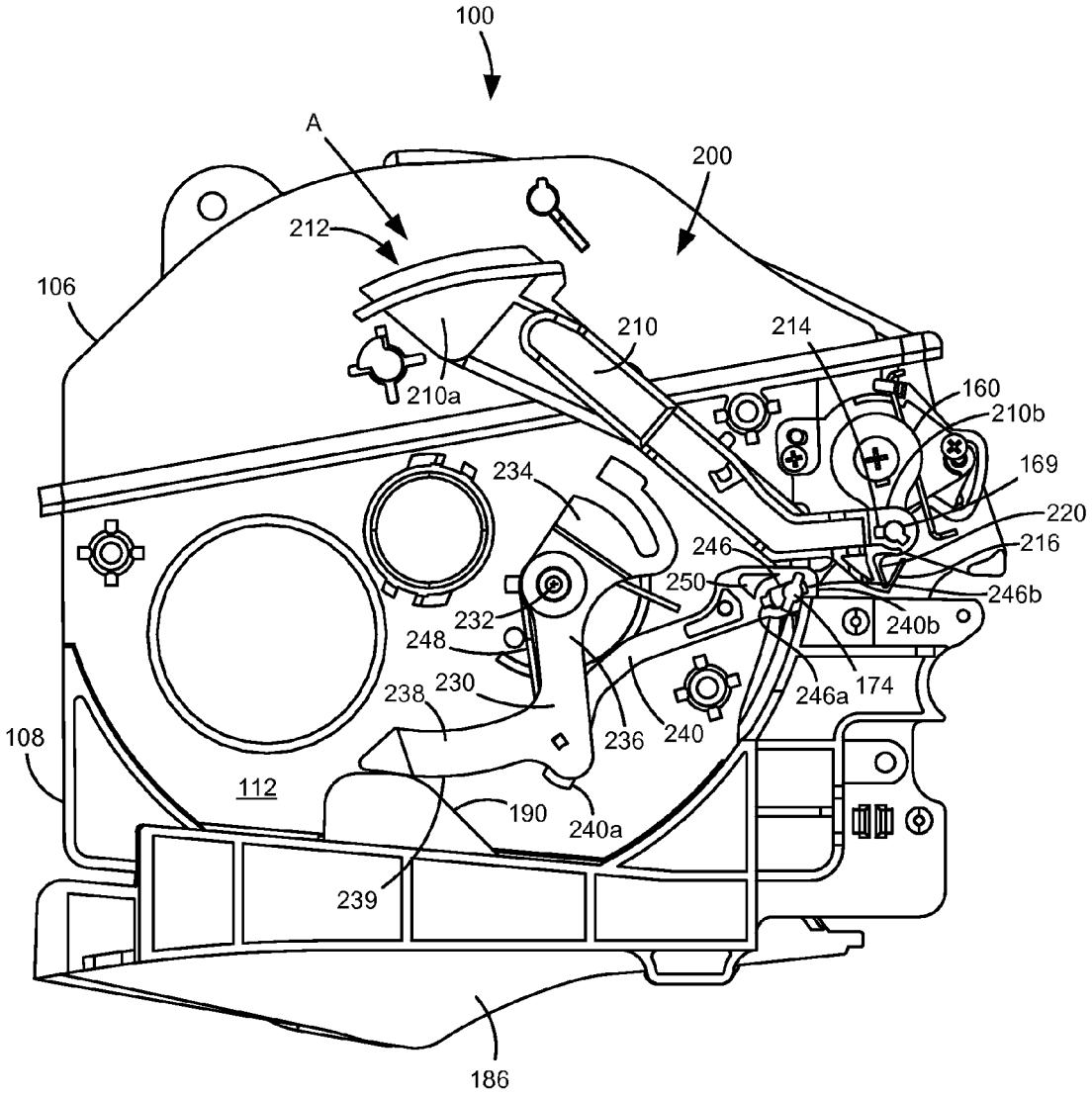
FIG. 15 is a side elevation view of the toner cartridge shown in FIGS. 10-14 showing the shutter lock mechanism in the unlocked position with the shutter opened.

With reference to FIGS. 10-15, in the example embodiment illustrated, a cover 170 is provided on toner cartridge 100 that is pivotable between a closed position illustrated in FIGS. 10-12 and an open position illustrated in FIGS. 13-15. FIGS. 11-15 show toner cartridge 100 with end cap 120 removed to more clearly illustrate the components housed between end cap 120 and side wall 112. With reference to FIGS. 10 and 11, in the closed position, cover 170 is pressed against exit port 152 and its surrounding surface 153 (shown in FIG. 13) to trap any residual toner within exit port 152 and prevent toner leakage. In the open position shown in FIG. 13, cover 170 is pivoted away from exit port 152 to permit toner to travel from exit port 152 into entrance port 188 of developer unit 182 (shown in FIG. 2). In the example embodiment illustrated, in the open position, cover 170 retracts into a recess 172 in front wall 114 that is sized and shaped to receive cover 170. This prevents cover 170 from applying an undesired force on developer unit 182 when toner cartridge 100 and imaging unit 180 are mated. It will be appreciated that developer unit 182 is precisely aligned to ensure proper toner transfer from the toner sump therein to the photoconductive drum housed in cleaner unit 184. Print defects may occur if this alignment is disturbed, such as by a force applied by cover 170 on developer unit 182. When cover 170 pivots from the open position to the closed position to cover exit port 152, it applies a sealing force that is substantially normal to exit port 152 with little to no sliding motion. This allows cover 170 to capture any toner present in or around exit port 152 without scraping or skiving it into image forming device 22 thereby reducing the amount of toner leakage. In one embodiment, cover 170 includes a piece of foam 171 on an inner face thereof that soaks up toner present on or around exit port 152. For example, foam 171 may include a flexible, open cell, polymer (e.g., polyurethane) foam, such as SUPER SEAL FOAM available from FXI, Media, Pa., USA.

Cover 170 is actuated when toner cartridge 100 is installed in image forming device 22 and, more particularly, when toner cartridge 100 is mated with imaging unit 180. This ensures that cover 170 is in the open position and exit port 152 is accessible when toner cartridge 100 is installed in the machine. When toner cartridge 100 is removed, cover 170 is in the closed position covering exit port 152 in order to prevent toner leakage. Cover 170 is biased toward the closed position. As discussed in greater detail below, as toner cartridge 100 is installed in image forming device 22, a projection or other engagement feature on image forming device 22 or imaging unit 180 engages cover 170 or a linkage thereto and provides a force sufficient to overcome the biasing force in order to open cover 170 to permit toner to flow from toner cartridge 100 to imaging unit 180. When toner cartridge 100 is removed from image forming device 22, the engagement between the engagement feature and cover 170 or the linkage thereto is broken causing cover 170 to close as a result of the bias.

With reference to FIGS. 11 and 12, a shutter lock mechanism 200 is housed between side wall 112 and end cap 120. Lock mechanism 200 includes a shutter linkage 210 that actuates lever 160 to open and close shutter 154. Lock mechanism 200 also includes a linkage member 230. As discussed in greater detail below, linkage member 230 provides an interlock that prevents shutter 154 from being opened unless toner cartridge 100 is installed within image forming device 22 and, more specifically, unless toner cartridge 100 is mated with imaging unit 180. In one embodiment, linkage member 230 also opens and closes cover 170.

In the example embodiment illustrated, linkage member 230 is pivotally attached to side wall 112 at an axis of rotation 232. Linkage member 230 includes a first leg 234 and a second leg 236 that each extend radially from axis of rotation 232. A third leg 238 extends in a curved manner from second leg 236 at an angle that is roughly perpendicular to second leg 236. Third leg 238 includes a curved engagement surface 239 on a front portion thereof that contacts a corresponding engagement feature, such as a fin 190 (FIG. 2) on frame 186 of imaging unit 180, when toner cartridge 100 is inserted into image forming device 22 to actuate linkage member 230 and open cover 170. A linkage member 240 is connected to linkage member 230 at a first end 240*a* of linkage member 240. In the example embodiment illustrated, linkage member 240 is a curvilinear bar. In this embodiment, a post extends from second leg 236 of linkage member 230 near the point where third leg 238 extends from second leg 236. The post is received by a corresponding channel in first end 240*a* of linkage member 240. In this embodiment, the post is rotatable within the channel in first end 240*a* to provide a greater range of motion between linkage member 240 and linkage member 230. However, it will be appreciated that linkage member 230 and linkage member 240 may be connected by any suitable means such as, for example, by reversing the post/channel configuration such that linkage member 240 includes a post and linkage member 230 includes a corresponding channel. Further, linkage member 240 and linkage member 230 may be connected at any suitable point along linkage member 230 or linkage member 240. A second end 240*b* of linkage member 240 is operatively connected to cover 170 such that the movement of linkage member 240 causes cover 170 to open and close. For example, in the embodiment illustrated, second end 240*b* of linkage member 240 includes a channel 246 therein. Channel 246 receives a post 174 that extends from cover 170.

A biasing member biases cover 170 toward the closed position. For example, in the embodiment illustrated, the biasing member is a spring 248 that biases linkage member 230 in a counter-clockwise direction as viewed in FIGS. 11-15. Linkage member 230 is biased toward a home position shown in FIGS. 11 and 12. In the embodiment shown, spring 248 is a torsion spring positioned at the axis of rotation 232 of linkage member 230. However, it will be appreciated that one or more biasing members may be provided at any suitable location(s) in shutter lock mechanism 200 as desired. Side wall 112 and/or an inner surface of end cap 120 may include guide features to limit the travel of the linkage member 230 and linkage member 240 to ensure that they maintain their desired alignment.

FIGS. 11-14 show the sequence of opening cover 170. FIGS. 11 and 12 show cover 170 fully closed and pressed against exit port 152. When cover 170 is fully closed, post 174 is positioned against a rear portion 246*a* of channel 246 in order to press cover 170 against exit port 152. As toner cartridge 100 is installed in image forming device 22, fin 190 or another engagement feature that projects from frame 186 is received in a slot 176 in a front portion of base 108 and/or end cap 120. As toner cartridge 100 is advanced further toward a mated position with imaging unit 180, fin 190 contacts engagement surface 239 of third leg 238 of linkage member 230. The force from fin 190 on linkage member 230 overcomes the biasing force supplied by spring 248 and causes linkage member 230 to rotate in a clockwise direction (as viewed in FIGS. 11-15) as toner cartridge 100 is advanced. As linkage member 230 rotates in the clockwise direction, linkage member 240 lowers which, in turn, causes cover 170 to pivot toward the open position. FIGS. 13 and 14 show cover 170 in the open position with linkage member 230 fully rotated. If additional clearance is needed to prevent cover 170 from applying an undesired force on developer unit 182, e.g., due to differences in component tolerances, channel 246 provides additional travel for post 174 of cover 170. For example, FIG. 13 shows post 174 slid to a front portion 246*b* of channel 246 and cover 170 retracted into recess 172 in front wall 114 in order to prevent the bias on cover 170 from affecting developer unit 182. When toner cartridge 100 is removed from image forming device 22, this sequence is reversed such that the biasing force from spring 248 causes linkage member 230 to rotate in a counter-clockwise direction (as viewed in FIGS. 11-15) which raises linkage member 240 causing cover 170 to pivot closed. End cap 120 shields assembly 200 from external interference.

With reference back to FIGS. 11 and 12, as mentioned above, shutter lock mechanism 200 prevents shutter 154 from being opened unless toner cartridge 100 is installed within image forming device 22 and, more specifically, unless toner cartridge 100 is mated with imaging unit 180. At one end 210*a*, shutter linkage 210 includes an engagement surface 212, such as a button-like area, that is exposed to an exterior portion of housing 102, such as a rear portion of end cap 120 next to lid 106 as shown. Shutter linkage 210 is connected at its opposite end 210*b* to lever 160. In the example embodiment illustrated, end 210*b* of shutter linkage 210 includes a channel 214 that receives post 169 extending from lever 160. However, shutter linkage 210 and lever 160 may be connected by any suitable means such as, for example, by reversing the post/channel configuration such that shutter linkage 210 includes a post and lever 160 includes a corresponding channel. Shutter linkage 210 is an elongated member that extends from end 210*a* having engagement surface 212 to end 210*b* that is connected to lever 160. Shutter linkage 210 also includes a catch 216 extending therefrom that engages with linkage member 240 when shutter lock mechanism 200 is in the locked position as described in greater detail below. In the example embodiment illustrated, catch 216 extends from a bottom portion of shutter linkage 210 near end 210*b* of shutter linkage 210.

Shutter linkage 210 is biased by a biasing member, such as, for example, an extension spring (hidden by shutter linkage 210), toward the exterior portion of housing 102 where end 210*a* is exposed, i.e., the position shown in FIGS. 11 and 12, to close shutter 154. It will be appreciated that one or more biasing members may be provided at any suitable location(s)

on shutter linkage 210 as desired. Shutter linkage 210 is translatable in the direction shown by arrow A in FIG. 12 when engagement surface 212 is depressed and the biasing force is overcome. As shutter linkage 210 translates in the direction indicated by arrow A, lever 160 rotates opening shutter 154.

Linkage member 240 is movable between a blocking or locked position shown in FIGS. 11 and 12 and a non-blocking or unlocked position shown in FIGS. 13-15. In the locked position, linkage member 240 prevents shutter 154 from opening by restricting the movement of shutter linkage 210. In the unlocked position, linkage member 240 permits shutter 154 to open and close freely by clearing away from shutter linkage 210. In the example embodiment illustrated, second end 240*b* of linkage member 240 includes a knob 250 that engages catch 216 of shutter linkage 210 to block the movement of shutter linkage 210 when linkage member 240 is in the locked position to prevent shutter linkage 210 from opening shutter 154. In the embodiment shown, knob 250 extends from a side portion of linkage member 240 away from side wall 112 and toward end cap 120 (out of the page as viewed in FIGS. 11-15) in the path of catch 216 of shutter linkage 210. As discussed above, linkage member 230 is biased toward the counter-clockwise direction as viewed in FIGS. 11-15. In this manner, linkage member 240 is biased into the path of shutter linkage 210 to prevent shutter 154 from opening prior to installation of toner cartridge 100 in image forming device 22.

Shutter lock mechanism 200 prevents shutter 154 from opening unless engagement surface 212 of shutter linkage 210 is depressed and engagement surface 239 of linkage member 230 is engaged. This prevents shutter 154 from opening unless toner cartridge 100 is mated with imaging unit 180 in its final position in image forming device 22. In use, imaging unit 180 is removably inserted in image forming device 22 prior to inserting toner cartridge 100. Toner cartridge 100 is then inserted into image forming device 22 and onto frame 186 in a mated relationship with imaging unit 180. As toner cartridge 100 advances toward its final position in image forming device 22, mated with imaging unit 180, fin 190 on frame 186 (or another engagement feature on imaging unit 180) is received in slot 176. Slot 176 limits the access to linkage member 230 to reduce the likelihood that a user will inadvertently unlock shutter lock mechanism 200. As toner cartridge 100 advances, fin 190 contacts engagement surface 239 of linkage member 230. The force from fin 190 on linkage member 230 overcomes the biasing force applied by spring 248 and causes linkage member 230 to rotate in a clockwise direction (as viewed in FIGS. 11-15). This, in turn, pulls linkage member 240 away from shutter linkage 210 as shown in FIGS. 14 and 15 and pulls knob 250 clear of the path of catch 216 thereby unlocking linkage member 240. After toner cartridge 100 is inserted into image forming device 22, when an access door to image forming device 22 is closed, a plunger or other form of projection extending from an inner surface of the access door (or otherwise linked to the access door) presses engagement surface 212 overcoming the biasing force on shutter linkage 210 and depressing shutter linkage 210 causing shutter linkage 210 to translate. This causes lever 160 to rotate to open shutter 154 as shown in FIG. 15. In this manner, shutter lock mechanism 200 ensures that shutter 154 remains closed unless toner cartridge 100 is installed in image forming device 22 and mated with imaging unit 180.

When toner cartridge 100 is removed from image forming device 22, this sequence is reversed. When the access door to image forming device 22 is opened, spring 218 retracts shutter linkage 210 to its biased position, closing shutter 154. As the user removes toner cartridge 100 from the device, fin 190 disengages from engagement surface 239 causing linkage member 230 and linkage member 240 to return to the locked position to ensure that shutter 154 remains closed while toner cartridge 100 is removed from image forming device 22.

If toner cartridge 100 is installed in image forming device 22 without imaging unit 180, shutter lock mechanism 200 will remain locked preventing shutter 154 from opening. Specifically, when engagement surface 212 is pressed, knob 250 will contact catch 216 on shutter linkage 210 and impede the translative motion of shutter linkage 210. If shutter 154 was opened without imaging unit 180 present, toner would be able to escape toner cartridge 100 through exit port 152 into the internal area of image forming device 22 potentially causing print defects. Shutter lock mechanism 200 prevents this from happening. Further, prior to insertion of toner cartridge 100 in image forming device 22, users may be tempted to press engagement surface 212 without realizing its function. Shutter lock mechanism 200 prevents a user from accidently opening shutter 154 when toner cartridge 100 is not installed in image forming device 22. Similarly, when toner cartridge 100 is inserted into image forming device 22 and mated with imaging unit 180, shutter 154 will remain closed until the access door is closed indicating that the device is ready to print.

In the example embodiment illustrated, shutter linkage 210 includes a flexible damping arm 220 that extends in front of catch 216 (toward front wall 114). If toner cartridge 100 is installed in image forming device 22 without imaging unit 180 and engagement surface 212 is pressed by a user closing the access door to image forming device 22, damping arm 220 contacts knob 250 and deflects backward toward catch 216 to slow the advance of shutter linkage 210. In this manner, damping arm 220 helps to prevent post 174 from cracking or breaking if the access door to image forming device 22 is slammed shut when toner cartridge 100 is installed but imaging unit 180 is not. If instead, shutter linkage 210 is allowed to travel at a relatively high rate of speed until catch 216 contacts knob 250, post 174 may tend to snap as a result of the force applied by shutter linkage 210.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A toner cartridge for use in an image forming device, comprising:

a housing having a reservoir for containing toner therein, the housing having an exit port on a front portion of the housing in fluid communication with the reservoir;

a shutter positioned at the exit port that is movable between an open position to permit toner from the reservoir to pass out of the exit port and a closed position to prevent toner from passing out of the exit port, the shutter being biased toward the closed position;

a first linkage member operatively connected to the shutter to open the shutter upon being actuated by a first engagement feature in the image forming device, the first linkage member having a first engagement surface positioned on a rear portion of the housing to contact the first engagement feature to open the shutter;

a second linkage member pivotally attached to a side wall of the housing and biased toward a home position, the second linkage member having a second engagement surface positioned on the front portion of the housing to contact a second engagement feature to pivot the second linkage member away from the home position; and a third linkage member movable with the second linkage member, wherein when the second linkage member is in the home position, the third linkage member is in a blocking position preventing the first linkage member from opening the shutter and when the second linkage member pivots away from the home position, the third linkage member moves to a non-blocking position permitting the first linkage member to open the shutter upon being actuated by the first engagement feature, further comprising a catch on the first linkage member that engages with the third linkage member when the first linkage member is actuated by the first engagement feature and the third linkage member is in the blocking position; and a flexible damping arm extending in front of the catch and positioned to contact the third linkage member and deflect backward when the first linkage member is actuated by the first engagement feature and the third linkage member is in the blocking position.

2. The toner cartridge of claim 1, further comprising a knob extending from the third linkage member positioned in a path of movement of the catch of the first linkage member when the third linkage member is in the blocking position.

3. The toner cartridge of claim 2, wherein the catch extends from a bottom portion of the first linkage member and the knob extends from a side portion of the third linkage member.

4. The toner cartridge of claim 1, wherein the first engagement surface is positioned on a first end of the first linkage member and a second end of the first linkage member is operatively connected to the shutter through a lever.

5. The toner cartridge of claim 1, further comprising a slot in the front portion of the housing that allows the second engagement feature to contact the second engagement surface as the toner cartridge is inserted in the image forming device.

6. The toner cartridge of claim 1, further comprising a cover mounted on an exterior portion of the housing pivotable between a closed position covering the exit port and an open position uncovering the exit port, the cover being operatively connected to the third linkage member such that when the third linkage member is in the blocking position, the cover is in the closed position and when the third linkage member moves to the non-blocking position, the cover moves to the open position.

7. The toner cartridge of claim 6, further comprising a channel in the third linkage member that receives a post extending from the cover.

8. A toner cartridge for use in an image forming device, comprising:

a housing having a reservoir for containing toner therein, the housing having an exit port on a front portion of the housing in fluid communication with the reservoir;

a shutter positioned at the exit port that is movable between an open position to permit toner from the reservoir to pass out of the exit port and a closed position to prevent toner from passing out of the exit port, the shutter being biased toward the closed position;

a cover mounted on an exterior portion of the housing pivotable between a closed position covering the exit port and an open position uncovering the exit port, the cover being biased toward the closed position;

a first linkage member operatively connected to the shutter to open the shutter upon being actuated by a first engagement feature in the image forming device, the first linkage member having a first engagement surface positioned on a rear portion of the housing to contact the first engagement feature to open the shutter;

a second linkage member pivotally attached to a side wall of the housing and biased toward a home position, the second linkage member having a second engagement surface positioned on the front portion of the housing to contact a second engagement feature to pivot the second linkage member away from the home position; and a third linkage member movable with the second linkage member and operatively connected to the cover such that when the second linkage member is in the home position, the cover is in the closed position and when the second linkage member pivots away from the home position, the third linkage member moves the cover to the open position, wherein when the second linkage member is in the home position, the third linkage member is in a blocking position preventing the first linkage member from opening the shutter and when the second linkage member pivots away from the home position, the third linkage member moves to a non-blocking position permitting the first linkage member to open the shutter upon being actuated by the first engagement feature.

9. The toner cartridge of claim 8, further comprising a catch on the first linkage member that engages with the third linkage member when the first linkage member is actuated by the first engagement feature and the third linkage member is in the blocking position.

10. The toner cartridge of claim 9, further comprising a flexible damping arm extending in front of the catch and positioned to contact the third linkage member and deflect backward when the first linkage member is actuated by the first engagement feature and the third linkage member is in the blocking position.

11. The toner cartridge of claim 9, further comprising a knob extending from the third linkage member positioned in a path of movement of the catch of the first linkage member when the third linkage member is in the blocking position.

12. The toner cartridge of claim 11, wherein the catch extends from a bottom portion of the first linkage member and the knob extends from a side portion of the third linkage member.

13. The toner cartridge of claim 8, wherein the first engagement surface is positioned on a first end of the first linkage member and a second end of the first linkage member is operatively connected to the shutter through a lever.

14. The toner cartridge of claim 8, further comprising a slot in the front portion of the housing that allows the second engagement feature to contact the second engagement surface as the toner cartridge is inserted in the image forming device.

15. The toner cartridge of claim 8, further comprising a channel in the third linkage member that receives a post extending from the cover.

* * * * *